US007217228B2

(12) United States Patent
Marquez

(10) Patent No.: US 7,217,228 B2
(45) Date of Patent: May 15, 2007

(54) LOW IMPACT EXERCISE SYSTEM

(76) Inventor: Al H. Marquez, 3315 San Felipe Rd. #92, San Jose, CA (US) 95135

( * ) Notice: Subject to any disclaimer, the term of this patent is extended or adjusted under 35 U.S.C. 154(b) by 61 days.

(21) Appl. No.: 11/009,326

(22) Filed: Dec. 10, 2004

(65) Prior Publication Data

US 2006/0128539 A1 Jun. 15, 2006

(51) Int. Cl.
*A63B 21/04* (2006.01)
*A63B 21/02* (2006.01)

(52) U.S. Cl. ..... 482/130; 482/122; 482/123; 482/126

(58) Field of Classification Search ..... 482/121, 482/123, 124, 126, 130, 133, 140, 907; 5/648–650; D21/686, 687
See application file for complete search history.

(56) References Cited

U.S. PATENT DOCUMENTS 1,734,238 A * 11/1929 Sweeney ..... 482/123
1,950,174 A * 3/1934 Harrison ..... 482/130
3,664,666 A * 5/1972 Lloyd ..... 482/133
4,314,697 A * 2/1982 Brumfield et al. ..... 482/123
4,489,936 A * 12/1984 Dal Monte ..... 482/96
4,757,994 A * 7/1988 Chenera ..... 482/142
4,853,993 A * 8/1989 Walpin et al. ..... 5/634
4,905,330 A * 3/1990 Jacobs ..... 5/705
5,405,306 A * 4/1995 Goldsmith et al. ..... 482/120
5,449,336 A * 9/1995 Sabel ..... 482/133
6,245,001 B1 * 6/2001 Siaperas ..... 482/142
2004/0014570 A1 * 1/2004 Centopani ..... 482/140

* cited by examiner

*Primary Examiner*—Stephen R. Crow
*Assistant Examiner*—Allana Lewin
(74) *Attorney, Agent, or Firm*—Bever, Hoffman & Harms, LLP; Jeanette S. Harms

(57) ABSTRACT

An exercise system includes a platform, a set of ankle holders connected to the platform by resistance (e.g., elastic) bands, and a leg support. A user can sit on the platform with her back supported by a back support (or fully reclined with her head/neck supported by a headrest) and with her legs supported by the leg support. After attaching the ankle holders to her ankles, the user can perform leg extensions as part of a cardiovascular and resistance workout. The leg support can be constructed so as to compress during each leg extension, thereby reducing knee strain and minimizing the potential for injury.

25 Claims, 5 Drawing Sheets

LOW IMPACT EXERCISE SYSTEM

BACKGROUND OF THE INVENTION

I. Field of the Invention

The invention relates to the field of fitness equipment, and in particular, to a safe, easy-to-use cardiovascular exercise system.

II. Related Art

For many people, the great appeal of exercise equipment is the opportunity such equipment affords to exercise in the privacy of their own homes. However, conventional exercise equipment such as treadmills, stair-steppers, elliptical trainers, and stationary bicycles can be overly taxing and difficult to use for individuals who are not in the best physical shape. Furthermore, the sizes and weights of such conventional equipment make them inconvenient to keep and store. The bulky, largely metal constructions of the exercise equipment can also cause bruises and other injuries for anyone who accidentally bumps into the equipment (either during exercise or while simply walking by the equipment). Finally, the relatively complex mechanical designs of conventional exercise systems makes them expensive, even though each system is typically only useful for a particular exercise (e.g., a treadmill can only be used for walking/jogging-type activities).

Accordingly, it is desirable to provide a low-cost, safe system for exercise that is suitable for use by people of all fitness levels.

SUMMARY OF THE INVENTION

Conventional exercise systems are expensive, bulky, and heavy, and can be difficult to use by people of limited physical fitness/capabilities (e.g., senior citizens). To overcome these limitations, an exercise system can include support elements for cradling a user in a comfortable sitting/reclining position and a cushion(s) and resistance tethers for allowing to user to perform a simple cardiovascular and resistance exercises.

In one embodiment, an exercise system can include a platform, a pair of ankle holders connected to the platform by resistance tethers, and a leg support placed on the platform between the resistance tethers adjacent to a seating area on the platform. In one embodiment, a back support that provides an inclined back support can be positioned on the platform adjacent to the seating area opposite to the leg support. In one embodiment, the back support can be held against the platform by a strap that loops around both the back support and the platform and interfaces with one or more attachment features (e.g., ridges, holes/eyelets, clips, hooks) on the platform. In another embodiment, the back support can be attached to the platform via hook and loop pads. Various other positional adjustment mechanisms for the back support can be used. In another embodiment, a headrest can be included in place of the back support.

The leg support can comprise a triangular, circular or other appropriate cross section, and can be formed from multiple layers that allow the height of the leg support to be adjusted. Alternatively, a height adjustment mechanism under the leg support can be used to provide height adjustments. The leg support can be constructed from a compressive material that can reduce knee strain when using the exercise system. In various embodiments, the compressive characteristics of the leg support can be provided by a foam, gas, or liquid core. In one embodiment, the leg support can comprise two separate leg supports (e.g., left and right leg supports).

In another embodiment, a footrest(s) can be placed adjacent to the leg support to ensure proper positioning of a user's feet when the user is using the exercise system. The footrest can comprise anything from a simple pad to a motorized lift system.

In one embodiment, the resistance tethers (e.g., rubber bands, elastic straps, spring-loaded cables, pulley-driven straps, weighted or flywheel-loaded cables, or any other resistance system) can be attached to the platform at a fixed attachment location (e.g., a hook, eyelet, post, snap, clip or hole). In another embodiment, the resistance tethers can be attached to the platform by an adjustment mechanism such as a winch to allow changes in resistance to be made without changing the resistance tethers themselves. A remote control unit can be provided to control such a motorized winch system to enable "on the fly" changes by the user to the resistance provided by the exercise system.

In another embodiment, the exercise system can include additional attachment features for attaching a handgrip to the platform via a resistance tether. The handgrip can then be grasped by a user to perform bicep curls, triceps extensions, assisted crunches. Alternatively or additionally, the handgrip can be used to assist the user in settling in to, or rising from, the exercise system. In another embodiment, a foot sleeve can be attached to the platform via a resistance tether to allow the user to perform shin curls.

The invention will be more fully understood in view of the following description and drawings.

DETAILED DESCRIPTION

Equipment

Conventional exercise systems are expensive, bulky, and heavy, and can be difficult to use by people of limited physical fitness/capabilities (e.g., senior citizens). To overcome these limitations, an exercise system can include support elements for cradling a user in a comfortable sitting/reclining position and a cushion(s) and elastic straps for allowing to user to perform a simple cardiovascular and resistance exercises.

Figure 1A:
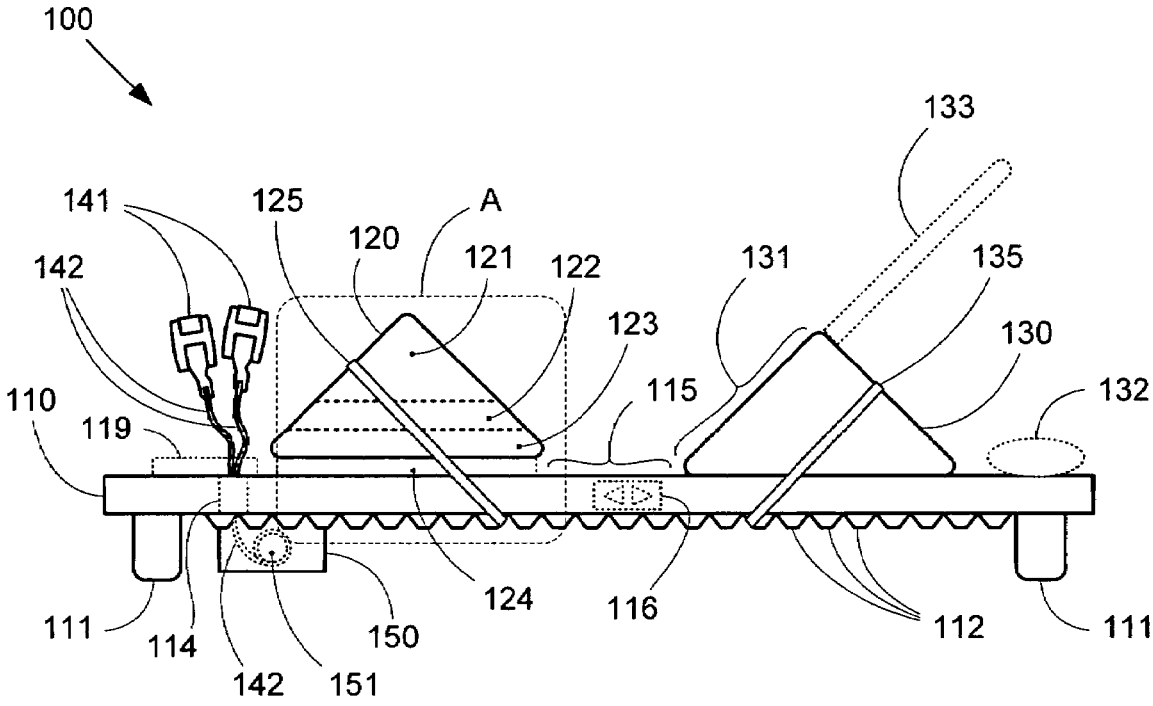
FIGS. 1A, 1B, and 1C are simplified diagrams of an exercise system that allows a user to safely perform low-impact cardiovascular and resistance exercises.

FIG. 1A shows an exercise system 100 that includes a platform 110, a leg support 120, a back support 130, resistance tethers 142, and ankle holders 141. Platform 110 can be any substantially rigid structure (e.g., a wood, plastic, or sheet metal structure) that provides a seating location 115 for a user. Note that while platform 110 is depicted as a solid, continuous structure for exemplary purposes, in various other embodiments, platform 110 could comprise a multi-piece structure. For example, in one embodiment, platform 110 could comprise a frame-type structure (e.g., a tubular metal frame) attached to a plate or platform providing seating location 115. Note further that while depicted as being substantially flat for explanatory purposes, platform 110 can have any shape that provides a seating location 115, and seating location 115 itself can have any shape (e.g., flat, contoured, or cushioned).

Platform 110 is supported by legs 111 and includes multiple attachment ridges 112 and an attachment mechanism 150. Note that while two sets of legs 111 (i.e., front and back) are shown for exemplary purposes, exercise system 100 can include any number of legs in any range of positions. Note further that while legs 111 are depicted as being relatively short for exemplary purposes, legs 111 can have any length. For example, short legs can provide good stability and a safe position when using exercise system 100. In one embodiment, exercise system 100 might not includes legs 111 at all, and platform 110 could sit directly on the ground. In another embodiment, exercise system 100 could include legs 111 only at the front of platform 110 (i.e., near leg support 120), with the rear of platform 110 resting directly on the ground. In another embodiment, legs 111 could be made longer to provide easier entry into and exit from exercise system 100, and/or to allow exercise system 100 to be used as a piece of furniture (e.g., a lounger) when not being used for exercise. In another embodiment, legs 111 can have different lengths (e.g., to support platform 110 at an incline).

Back support 130 is attached to platform 110 by a strap 135 that loops around both back support 130 and platform 110. The position of back support 130 relative to platform 110 is maintained by hooking strap 135 around one of ridges 112 on the bottom of platform 110. Back support 130 includes an inclined portion 131 that is shaped to provide back support for a user seated on platform 110 (as described in greater detail below with respect to FIG. 2A). Note that while inclined portion 131 is depicted as being a relatively flat surface for exemplary purposes, inclined portion 131 can have any other type of contour (e.g., inwardly curved, outwardly curved, shaped to fit any number of human back contours).

Note further that while depicted as having a substantially triangular cross section for exemplary purposes, back support 130 can have any cross section that provides inclined portion 131. The construction of back support 130 can be rigid (e.g., a stiff plastic form) or compressible (e.g., a foam core surrounded by a removable vinyl cover). In some embodiments, back support 130 can comprise a relatively thin plate or shell that provides inclined portion 131. The thin plate/shell could then be held in place by any sort of support mechanism, such as a locking hinge between platform 110 and the plate/shell or a support arm for bracing the plate/shell at a desired angle relative to platform 110.

Note further that while back support 130 is depicted as being relatively short for exemplary purposes, in various other embodiments, back support 130 have any height (e.g., to provide support all the way to the head of a user. For example, in one embodiment, back support 130 could include an optional extension 133 (indicated by the dotted line) for providing user head support.

Note further that while a strap/ridge system is depicted in FIG. 1A for exemplary purposes, any attachment means can be used to attach back support 130 to platform 110. For example, the ends of strap 135 could be terminated with hooks, loops, clips, or any other type of coupling mechanism, and ridges 112 could be replaced with a set of appropriate mating features (e.g., if the ends of strap 135 include hooks, ridges 112 can be replaced with holes, eyelets, hooks, posts, or any features that to which the hooks of strap 135 can be secured). Alternatively, strap 135 and/or ridges 112 could be eliminated completely through the use of mating hook-and-loop patches (e.g., Velcro™), straps that are permanently attached to back support 130 and/or platform 110, and mechanical latches and other quick disconnects, among other options. In various other embodiments, back support 130 can be coupled to platform 110 via any other type of positional adjustment system (e.g., rails, slides, screw-drive mechanism) for adjusting and setting the position of back support 130 (e.g., forward, backward, up, down, and/or angle of incline).

Note further that in another embodiment, back support 130, which is designed to support a user in a semi-reclined position, can be replaced with a headrest 132 (shown using dotted lines) to provide head and/or neck support for a fully-reclined user. Headrest 132 can, for example, be a cushion, a molded plastic support, or a raised portion of platform 110, among others. In another embodiment, platform 110 itself can be padded to provide comfortable support for a reclined user. Various other back and/or head support configurations will be readily apparent.

Resistance tethers 142 connect ankle holders 141 to platform 110 at attachment mechanism 150. Attachment mechanism 150 can comprise any mechanism for attaching resistance tethers 142 to platform 110, such as a hook, eyelet, post, snap, clip or hole, among others. In one embodiment, attachment mechanism 150 can comprise a spring or springs between resistance tethers 142 and platform 110 for reducing the stress on platform 110. Note that because attachment mechanism 150 is on the underside of platform 110, an aperture 114 is provided through platform 110 to allow resistance tethers 142 to reach attachment mechanism 150. In other embodiments, attachment mechanism 150 could be located on the sides or top of platform 110, in which case aperture 114 would not be required.

Each of ankle holders 141 provides an opening for encircling an ankle (or foot, or any body part in close proximity to the ankle) of a user. Ankle holders 141 can therefore comprise any sleeve-like structure that can be fastened to an ankle, such as an adjustable cuff, a neoprene sleeve, or even a plastic loop, among others. Likewise, resistance tethers 142 can comprise any structure that provides a resistive force along the direction of extension, such as elastic bands (e.g., high-strength rubber bands or elastic tubing), springs, or relatively inelastic cables coupled to a loading mechanism (i.e., hydraulics, springs, weights, pulley systems, a flywheel, or any other type of loading mechanism that can provide resistance opposing the motion of the cables in a particular direction), among others.

In one embodiment, the resistance provided by resistance tethers 142 can be adjusted simply by switching between rubber bands of different elasticities (e.g., thicker/thinner bands, or multiple bands). In another embodiment, attachment mechanism 150 can provide adjustments that increase or decrease the resistance seen by the user. For example, in one embodiment, attachment mechanism can include different sets of attachment points at different distances from aperture 114. The resistance seen by the user can then be increased by using attachment points farther from aperture 114 to attach resistance tethers 142 to platform 110. In another embodiment, attachment mechanism 150 can include a (manual or electric) winch system 151 for winding/unwinding resistance tethers 142 to increase/decrease the resistance felt by the user. Various other resistance adjustment systems will be readily apparent.

Leg support 120 is positioned on platform 110 on the opposite side of seating location 115 as back support 130

(i.e., seating location 115 is between back support 130 and leg support 120). Note that while leg support 120 is depicted as having a substantially triangular cross section for exemplary purposes, leg support 120 can have any cross sectional shape that can provide support for the legs of a user (e.g., round, trapezoidal, oval, or semicircular). Note that while the triangular leg support 120 will typically provide support for the calves, knees, and thighs of a user, in various other embodiments, leg support 120 can support any portion or combination of the parts of a user's legs For example, in one embodiment, leg support 120 can provide support at only the thighs of a user.

In one embodiment, optional foot supports 119 can be provided on platform 110 adjacent to leg support 120 to provide a stable foot rest position. Foot supports 119 can be any type of foot support structures, such as resilient pads or a mechanized lift system (for providing different foot rest heights), among others.

In one embodiment, leg support 120 can be designed as a resilient compressible structure that compresses under load and returns to its original ("unloaded") shape once the load is removed (as described in greater detail with respect to FIG. 2B, below). For example, leg support 120 can comprise a resilient compressible cushion that includes a foam element (e.g., a foam core in a vinyl cover) or an air or liquid-filled bladder. Various other resilient compressible structures will be readily apparent. For example, leg support 120 could include one or more plates hinged to platform 110 in the vicinity of seating area 115, with the free end of the plate(s) being supported by hydraulics, springs, pulleys, elastic supports, or any other mechanism capable of providing a resilient support once a user's legs are placed upon the plate(s). Typically, "compressible" means that leg support 120 can be deformed from its unloaded position by at least one or more inches during use of exercise system 100.

Note that because of the nature of the exercise performed using leg support 120 (described in greater detail below with respect to FIG. 2B), leg support 120 need not be attached to platform 110. Therefore, while a strap 125 (similar to strap 135 described above) is shown holding leg support 120 against platform 110 for exemplary purposes, in various other embodiments, leg support 120 can simply be placed onto platform 110 without any supplemental attachment mechanism. In other embodiments, leg support 120 can be attached to platform 110 by various types of adjustment mechanisms (e.g., rails, slides, and hook and loop pads, among others) to allow leg support 120 to be moved to different positions relative to seating location 115.

To allow for different size users, it is desirable to provide leg support at different heights. In one embodiment, height adjustments can be provided by switching out leg support 120 entirely with a support of a different size. In another embodiment, leg support 120 can include multiple layers (e.g., layers 121, 122, and 123) that can be added or removed for height adjustments. In another embodiment, an optional height adjustment mechanism 124 can be placed under leg support 120 to provide height adjustments (e.g., via mechanical or hydraulic lifts). An optional control unit 116 can also be included to allow the user to remotely control optional height adjustment mechanism 124 (control unit 116 can alternatively or additionally control the adjustment of resistance tethers 142). Similar height adjustment capabilities can be incorporated into back support 130.

Figure 1B:
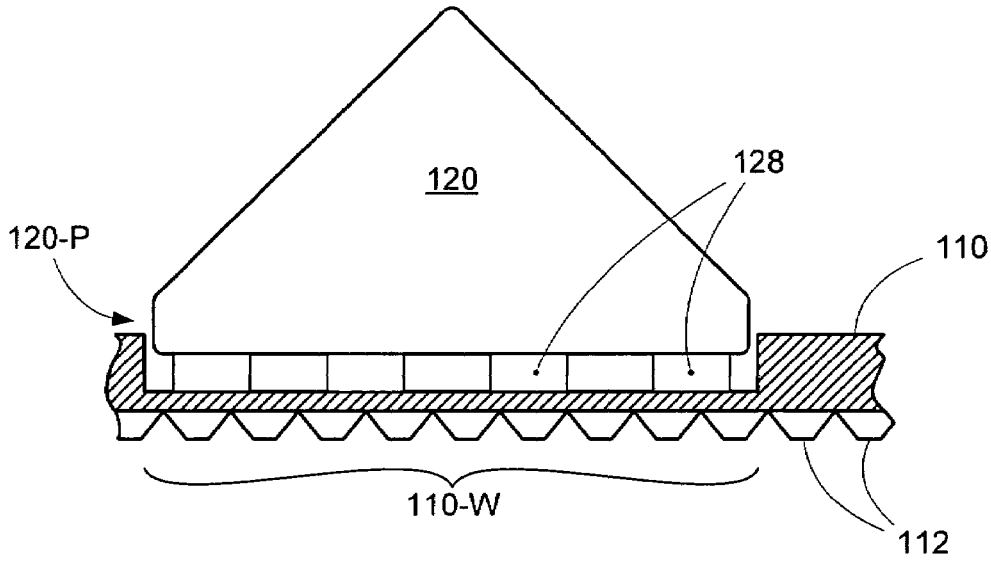

Various other height adjustment systems for leg support 120 will be readily apparent. For example, FIG. 1B shows a detail view of a portion A of exercise system 100 that a height adjustment system for leg support 120, in accordance with another embodiment of the invention. As shown in FIG. 1B, platform 110 can include a well 110-W, into which a portion 120-P of leg support 120 can be inserted. Note that while the sidewalls of well 110-W are depicted as being substantially perpendicular to the surface of platform 110, in various other embodiments, the sidewalls of well 110-W can have any shape and configuration (e.g., inclined sidewalls to help retain portion 120-P of leg support 120 in well 110-W. One or more risers 128 (i.e., support elements) in well 110-W under portion 120-P can then control the height of leg support 120. Note that in one embodiment, risers 128 can simply be removable/replaceable support blocks (i.e., taller risers 128 to raise leg support 120 and shorter risers 128 to lower leg support 120). In another embodiment, risers 128 can comprise an adjustable-height mechanism (manual or motorized) that itself changes height to adjust the height of leg support 120.

Figure 1C:
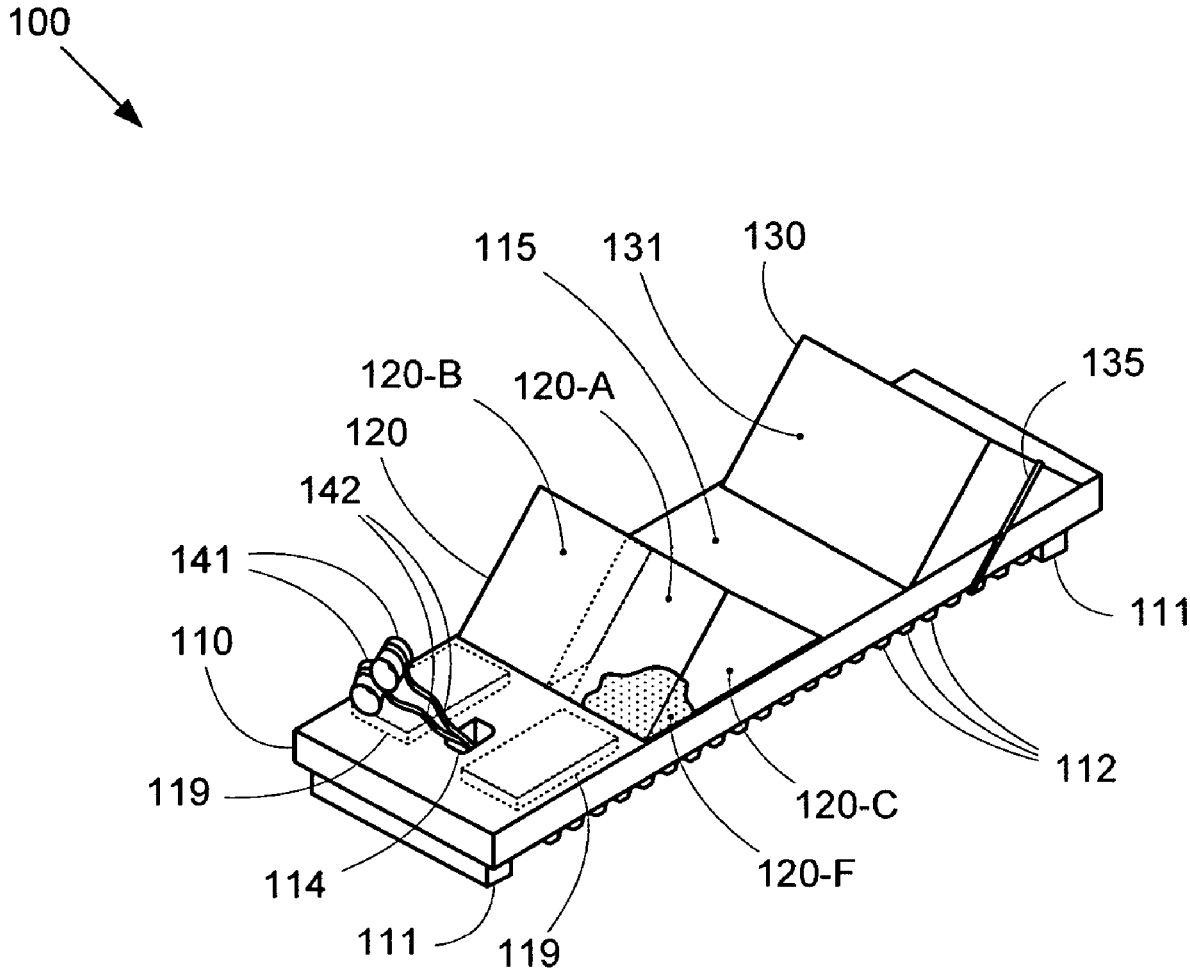

FIG. 1C shows a perspective view of exercise system 100 shown in FIG. 1A. As shown in FIG. 1C, leg support 120 and back support 130 are positioned on platform 110 adjacent to a seating location 115 on platform 110 (with back support 130 providing an inclined portion 131 in close proximity to seating location 115 for user back support).

Back support 130 is held against platform 110 by strap 135, which hooks around one of ridges 112 to maintain the position of back support 130 relative to platform 110. Meanwhile, ankle holders 141 are connected to platform 110 by resistance tethers 142, which pass through aperture 114 and connect to the bottom of platform 110. Optional foot supports 119 (shown using dotted lines) are positioned adjacent to leg support 120.

A partial cutaway view of leg support 120 is provided, which depicts the exemplary construction of a cover 120-C over a foam core 120-F (shaded portion). Note that according to an embodiment of the invention, leg support 120 can actually comprise two separate leg supports 120-A and 120-B (indicated by the dotted lines), thereby providing independent supports for each leg of a user (i.e., a left leg support 120-A and a right leg support 120-B).

In this manner, the relatively simple construction of exercise system 100 results in a system that can does not occupy much space and can be easily stored. At the same time, the simple construction also allows exercise system 100 to be produced at a much lower cost than conventional exercise systems.

Exercises

Figure 2A:
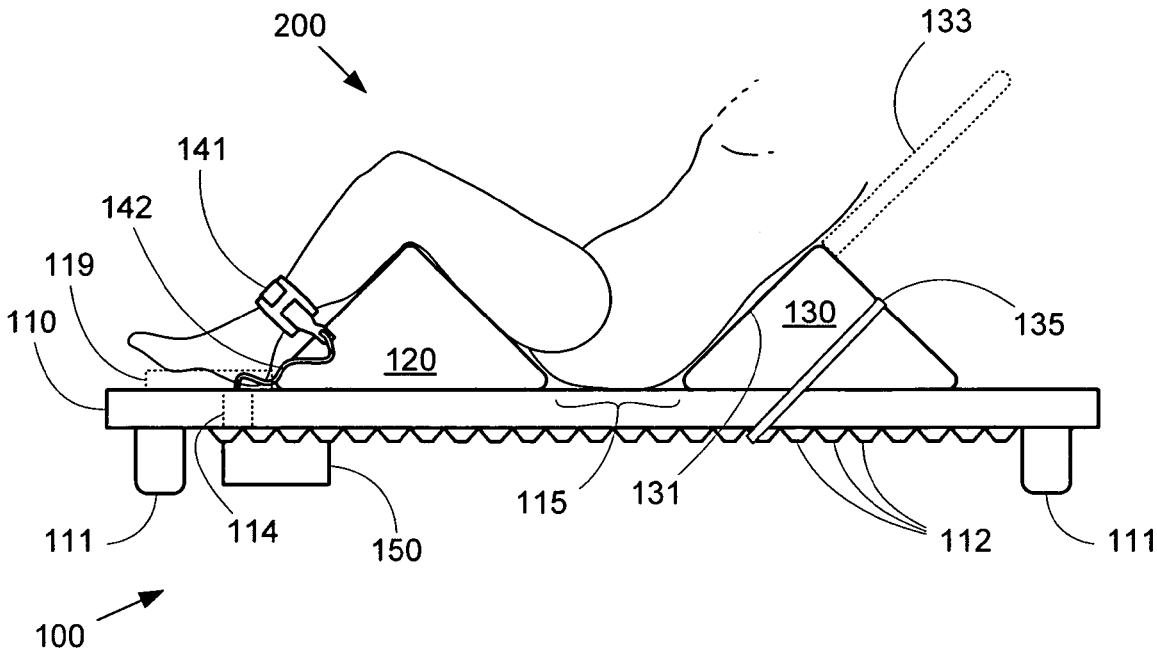
FIGS. 2A and 2B are usage diagrams for one type of exercise that can be performed using the exercise system of FIGS. 1A and 1B.
Figure 2B:
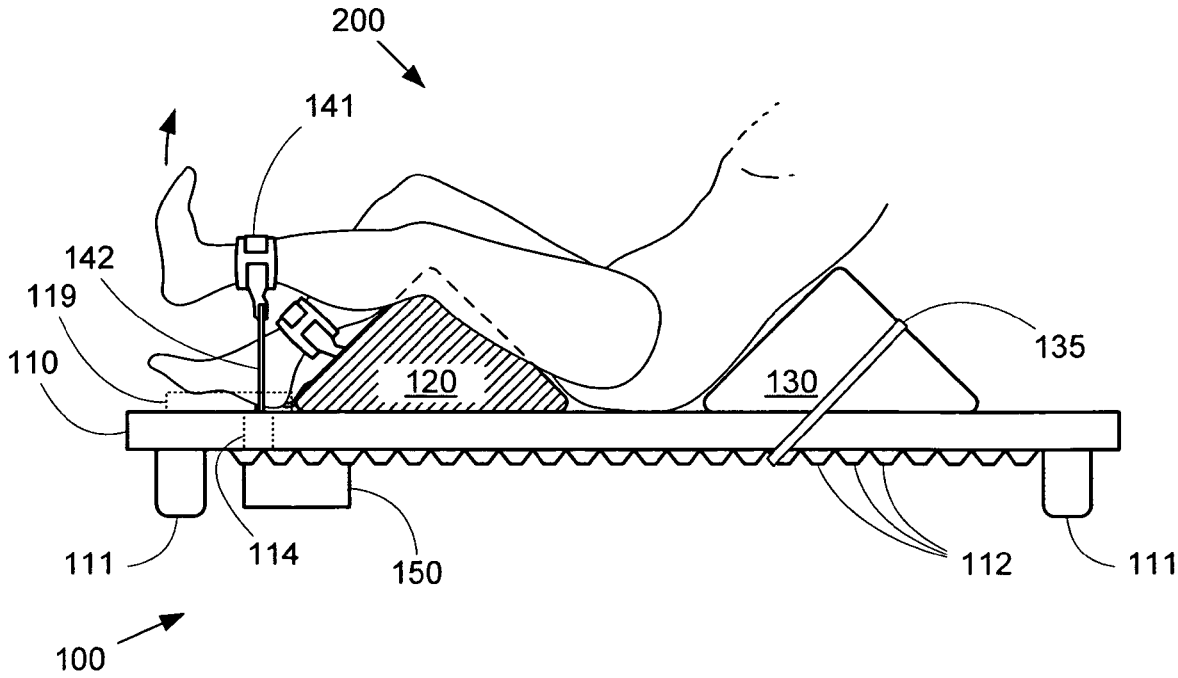

The use of exercise system 100 (described above with respect to FIG. 1A) is depicted in FIGS. 2A and 2B. In FIG. 2A, a user 200 positions herself in exercise system 100 by sitting on seating location 115 of platform 110, with her back resting against inclined portion 131 of back support 130 and her legs placed over leg support 120. User 200 is therefore placed in a semi-reclined position. Note that if back support 130 is replaced with a headrest (e.g., headrest 132 shown in FIG. 1A), user 200 would be placed in a fully-reclined position. Note further that optional extension 133 can provide additional back and head support for user 200.

Ankle holders 141 can then be attached to the ankles of user 200. In some instances, it may be desirable for the heels of user 200 to be in contact with platform 110 when user 200 is in the "rest" position shown in FIG. 2A. If the height of leg support 120 and the leg length of user 200 make such heel positioning difficult, optional foot support(s) 119 can be used to provide the desired heel positioning.

Note that the seated/reclined position imposed by exercise system 100 is a very natural and comfortable position. Even if user 200 has limited or reduced physical capabilities (e.g., limited strength, poor balance), the seated/reclining position shown in FIG. 2A can be easily achieved, as it is quite similar to sitting in a recliner or lounger. Furthermore, the secure support provided by leg support 120 and back support 130 help to ensure that user 200 does not fall out of exercise system 100 (even though legs 111 of platform 110 can be made short enough that such a fall would be unlikely to cause any injury).

Once user 200 is in place in exercise system 100 and is secured to ankle holders 141, user 200 can begin exercising by extending her legs (i.e., flexing her quadriceps muscles), as shown in FIG. 2B. These leg extensions can be performed in any pattern (e.g., alternating legs, both legs at once, one leg at a time). As user 200 straightens her leg, the resistance tether 142 attached to the ankle holder 141 for that leg exerts a force opposite to the direction of extension.

Note that the relatively unconstrained nature of the motion (due to the flexible resistance tethers 142) allows the leg extensions to be performed in a wide range of foot/leg positions. For example, by turning her feet inward (towards each other) during the exercise, user 200 can increase the work performed by the abductor muscles of her legs. Alternatively, by turning her feet outwards (away from each other) during the exercise, user 200 can increase the work performed by the adductor muscles of her legs. Other exercise variations will be readily apparent.

In one embodiment, the resistive force provided by resistance tether 142, coupled with the straightening of the leg of user 200, can compress leg support 120, as shown in FIG. 2B. The compressed cross section of leg support 120 is shown shaded, with the original (uncompressed) cross section shown as a dashed line for reference. This compression of leg support 120 reduces the stress the leg extension places on the knee of user 200, thereby minimizing the chance of injury while still providing an opportunity for a good workout. The compressed leg support 120 provides an upward force on the leg(s) of user 120 that tends to work in opposition to the downward force on the leg(s) of user 120 provided by resistance tether(s) 142, which can further improve the workout effectiveness of exercise system 100. Optional foot supports 119 (if present) can also provide workout enhancement by cushioning the heels of user 200 at the end of the downward leg motion, while also providing some upward "spring" at the start of the extension portion of the exercise.

Note that by selecting resistance tethers 142 to have a relatively high elasticity (i.e., bands that provide a larger amount of "stretch"), the exercise depicted in FIG. 2B can be performed regularly over a relatively long time period to provide a good cardiovascular workout to improve heart and lung capacity. Alternatively, by selecting resistance tethers 142 to have a relatively low elasticity (i.e., bands that do not stretch as much), the exercise depicted in FIG. 2B can be performed in shorter sets using a low number of repetitions to provide a resistance (load bearing) workout for improving muscular strength and bone density. Furthermore, the a user can perform high speed (e.g. "sprinting") repetitions or low speed (e.g., "walking") repetitions, depending on the type of exercise desired.

Figure 3A:
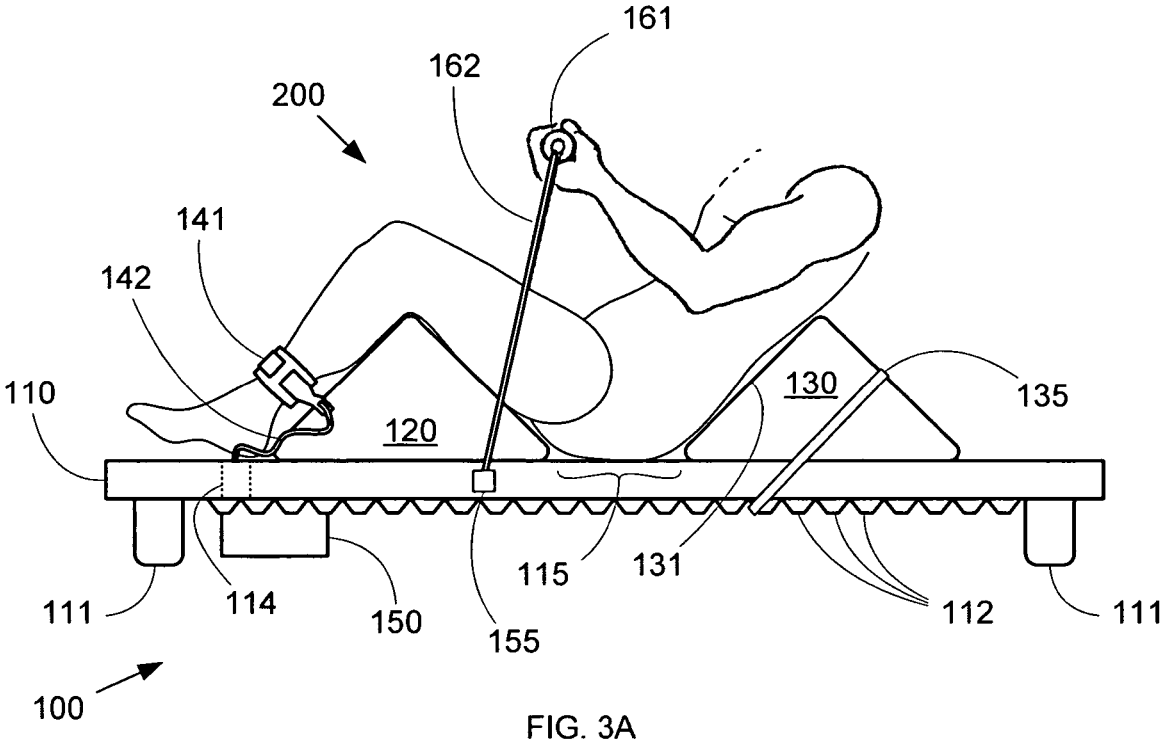
FIGS. 3A, 3B, 3C and 3D depict various alternative exercises that can be performed using the exercise system of FIGS. 1A and 1B.

Exercise system 100 can be readily adapted to enable the performance of various different exercises. For example, in FIG. 3A, an attachment mechanism 155 (e.g., an eyelet, hook, or post) is provided towards the front of platform 110 to permit attachment of a grip handle 161 (e.g., a bar or a ring) to platform 110 via a resistance tether 162. Grip handle 161 can then be used to perform bicep curls, as shown in FIG. 3A.

Figure 3B:
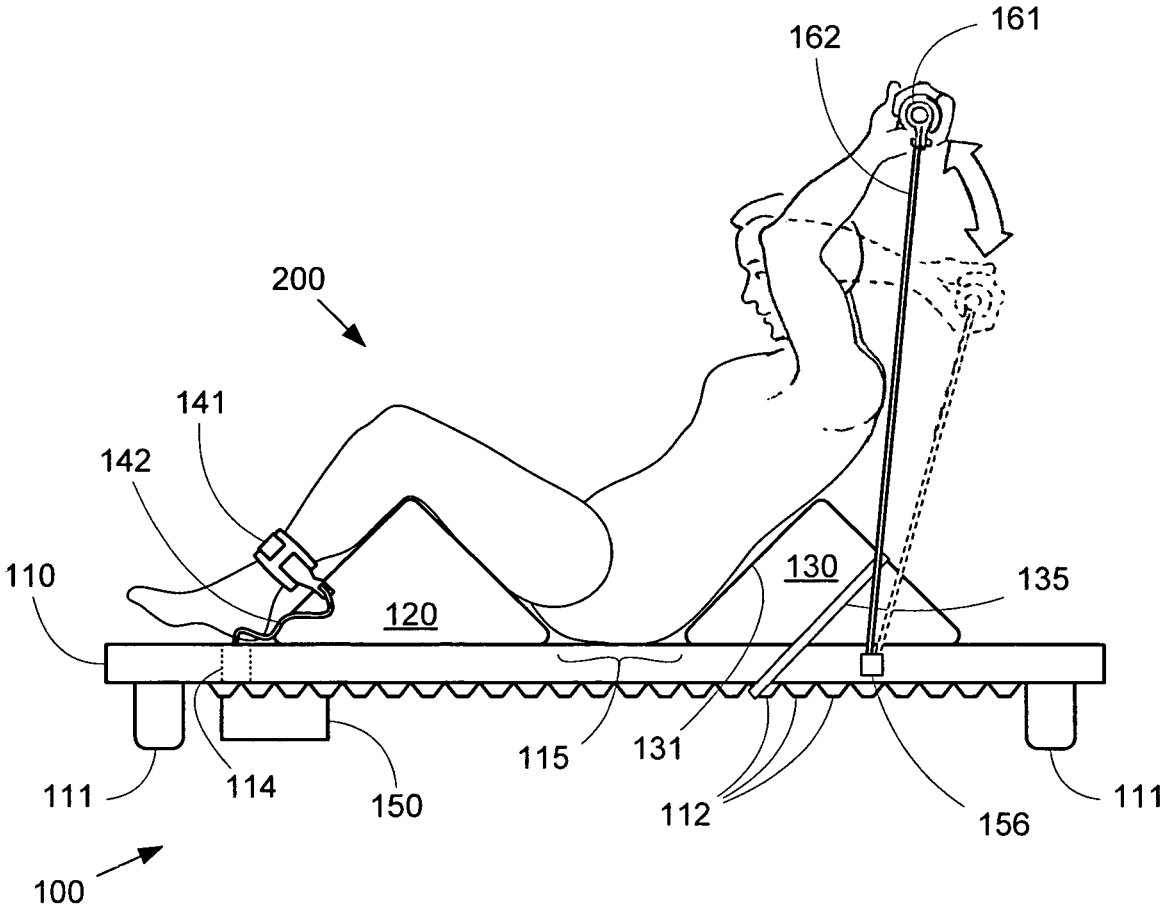

In FIG. 3B, an attachment mechanism 156 is provided towards the rear of platform 110 to permit attachment of grip handle 161 to platform 110 via resistance tether 162. Configured in this manner, exercise system 100 can be used to perform triceps extensions, as shown in FIG. 3B.

Figure 3C:
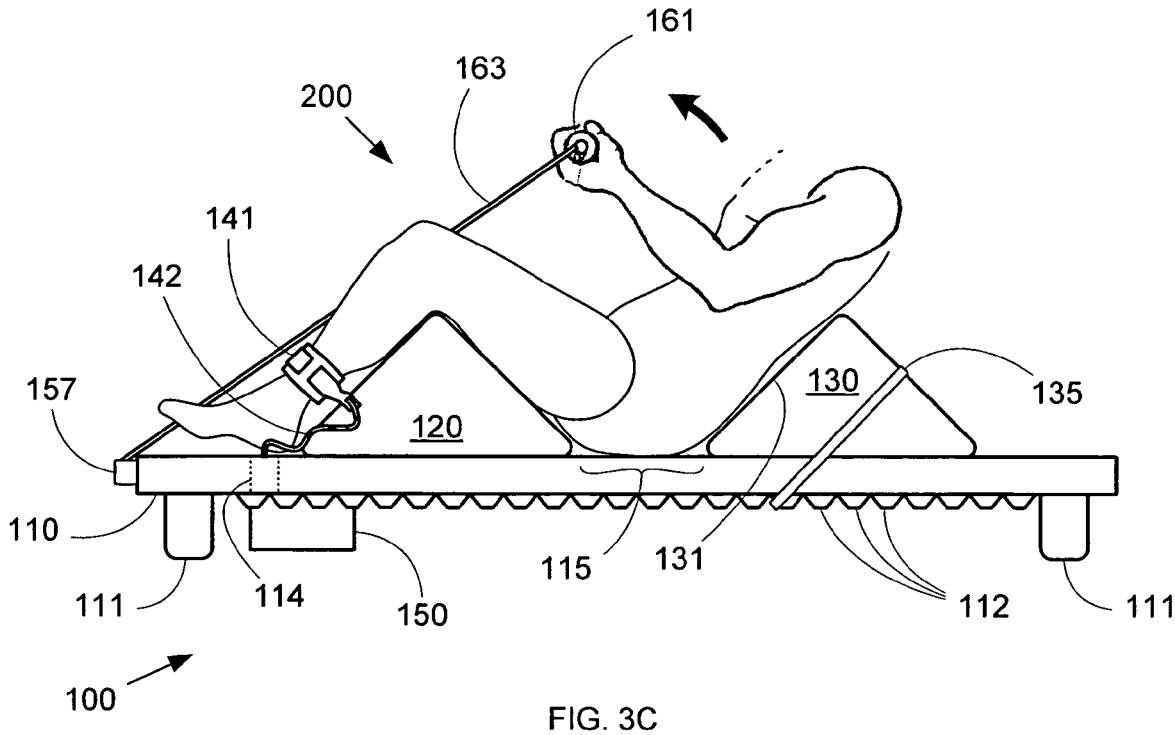

In FIG. 3C, an attachment mechanism 157 is provided towards the front of platform 110 to permit attachment of grip handle 161 to platform 110 via a tether 163. Grip handle 161 can then be used to assist user 200 in seating herself in, or raising herself from exercise system 100. This seating/rising assistance can be particularly beneficial when user 200 has a reduced physical capacity (e.g., poor balance or insufficient strength to easily rise from a reclined position). Alternatively, grip handle 161 can be used by user 200 to perform assisted crunches (i.e., pulling on grip handle 161 while contracting the abdominal muscles/obliques to raise the torso of user 200 in the direction indicated by the arrow). Typically, tether 163 can provide the more effective assistance during seating/rising or crunches if tether 163 is substantially inelastic.

Figure 3D:
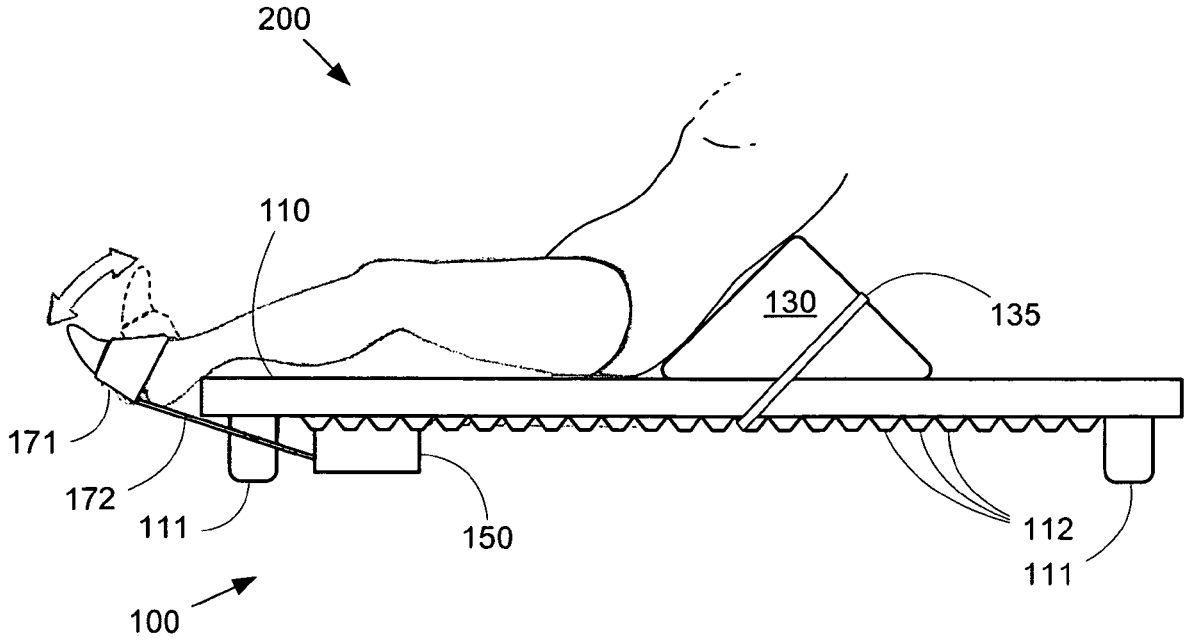

In FIG. 3D, a foot holder(s) 171 is connected to platform 110 via a resistance tether 172 that attaches to attachment mechanism 150. Foot holder 171 slips over the foot of user 200, and allows "shin curls" (i.e., contraction of the tibialis anterior muscle) to be performed, which can be particularly beneficial in the prevention of shin splints. Various other exercise possibilities will be readily apparent.

Although the invention has been described in connection with several embodiments, it is understood that the invention is not limited to the embodiments disclosed, but is capable of various modifications that would be apparent to one of ordinary skill in the art. For example, resistance tethers 142 in exercise system 100 could be replaced with hydraulics for providing resistance during the leg extensions. Thus, the invention is limited only by the following claims and their equivalents.

The invention claimed is:

1. An exercise system comprising:

a platform comprising a seating area, a bottom surface of the platform including a plurality of ridges;

a back support adjustably positioned on the platform using a strap that engages at least a first ridge;

a first ankle holder connected to the platform by a first resistance tether;

a second ankle holder connected to the platform by a second resistance tether; and a leg support adjustably positioned on the platform using a second strap that engages at least a second ridge, the leg support configured to provide support for bent legs and variable resistance in conjunction with the first and second resistance tethers.

2. The exercise system of claim 1, wherein the first resistance tether and the second resistance tether comprise elastic bands.

3. The exercise system of claim 2, wherein the first resistance tether and the second resistance tether are attached to the platform by one or more springs.

4. The exercise system of claim 1, wherein the first resistance tether and the second resistance tether comprise substantially inelastic cables coupled to a loading mechanism for providing resistance in a first direction as the substantially inelastic cables are moved in a second direction, the first direction being substantially opposed to the second direction.

5. The exercise system of claim 4, wherein the loading mechanism comprises at least one of a spring, a hydraulic system, a weight, a pulley system, and a flywheel.

6. The exercise system of claim 1, wherein the leg support is compressible and resilient.

7. The exercise system of claim 6, wherein the leg support comprises a foam core.

8. The exercise system of claim 6, wherein the leg support comprises at least one of hydraulics and springs.

9. The exercise system of claim 6, wherein the leg support comprises a substantially triangular cross section.

10. The exercise system of claim 9, wherein the leg support comprises a plurality of discrete layers, wherein each of the plurality of discrete layers can be removed from the leg support to adjust a height of the leg support.

11. The exercise system of claim 9, further comprising a height adjustment mechanism between the platform and the leg support.

12. The exercise system of claim 1, wherein the platform comprises a well, and wherein the leg support comprises a first portion sized to fit into the well, and a second portion extending above the well, the first portion of the leg support being supported in the well by one or more support elements.

13. The exercise system of claim 12, wherein the one or more support elements comprise one or more removable blocks.

14. The exercise system of claim 12, wherein the one or more support elements comprise an adjustable height mechanism.

15. The exercise system of claim 1, wherein the leg support comprises a right leg support and a left leg support.

16. The exercise system of claim 1, further comprising an attachment mechanism for connecting the first resistance tether and the second resistance tether to the platform.

17. The exercise system of claim 16, wherein the attachment mechanism is on a bottom surface of the platform, and wherein the first resistance tether and the second resistance tether are connected to the attachment mechanism through an aperture in the platform.

18. The exercise system of claim 17, wherein the attachment mechanism comprises one of a hook, an eyelet, a post, a snap, a clip, and a hole.

19. The exercise system of claim 17, wherein the attachment mechanism comprises a winch system for winding up the first resistance tether and the second resistance tether.

20. The exercise system of claim 19, further comprising a control unit for controlling the winch system.

21. The exercise system of claim 1, further comprising a headrest, wherein the seating area is located between the headrest and the leg support.

22. The exercise system of claim 1, further comprising a footrest adjacent to the leg support, wherein the leg support is located between the seating area and the footrest.

23. The exercise system of claim 22, wherein a height of the footrest is adjustable.

24. The exercise system of claim 1, further comprising:

a secondary attachment mechanism on the platform;

a handgrip; and a third resistance tether connecting the handgrip to the secondary attachment mechanism.

25. The exercise system of claim 1, further comprising:

a secondary attachment mechanism on the platform;

a foot sleeve sized to slip over a human foot; and a third resistance tether connecting the foot sleeve to the secondary attachment mechanism.

* * * * *